US007660541B2

(12) United States Patent
Tanimoto et al.

(10) Patent No.: US 7,660,541 B2
(45) Date of Patent: Feb. 9, 2010

(54) IMAGE FORMATION APPARATUS UTILIZING DENSITY OF WASTE TONER TO DETECT AMOUNT THEREOF

(75) Inventors: Junichi Tanimoto, Toyokawa (JP); Ryoichi Yamamoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 167 days.

(21) Appl. No.: 11/984,195

(22) Filed: Nov. 14, 2007

(65) Prior Publication Data

US 2008/0317483 A1 Dec. 25, 2008

(30) Foreign Application Priority Data

Jun. 22, 2007 (JP) ..... 2007-165471

(51) Int. Cl.
*G03G 21/12* (2006.01)

(52) U.S. Cl. ..... 399/35; 399/120

(58) Field of Classification Search ..... 399/9, 399/24, 25, 27, 34, 35, 107, 110, 119, 120
See application file for complete search history.

(56) References Cited

U.S. PATENT DOCUMENTS

| | | | | |
|---|---|---|---|---|
| 4,982,230 | A * | 1/1991 | Ogura et al. | 399/35 |
| 5,341,200 | A * | 8/1994 | Thomas | 399/111 |
| 5,634,172 | A * | 5/1997 | Manabe | 399/35 |
| 6,546,225 | B2 * | 4/2003 | Wang | 399/358 |
| 6,580,881 | B2 * | 6/2003 | Coriale et al. | 399/35 |
| 7,324,780 | B2 * | 1/2008 | Yamada et al. | 399/358 |
| 2008/0317484 | A1 | 12/2008 | Tanimoto et al. | |

FOREIGN PATENT DOCUMENTS

| | | | |
|---|---|---|---|
| JP | 60125877 | A | 7/1985 |
| JP | 01277275 | A | 11/1989 |
| JP | 02064684 | A | 3/1990 |
| JP | 4-186376 | A | 7/1992 |
| JP | 04303876 | A | 10/1992 |
| JP | 2002-169449 | A | 6/2002 |
| JP | 2006162941 | A | 6/2006 |

OTHER PUBLICATIONS

Notice of Grounds of Refusal for Japanese Appln. No. 2007-165471, with English-Language translation, dated Apr. 14, 2009.
Notice of Grounds of Refusal for Japanese Appln. No. 2007-165472, with English-Language translation, dated Apr. 14, 2009.

* cited by examiner

*Primary Examiner*—Hoan H Tran
(74) *Attorney, Agent, or Firm*—Buchanan Ingersoll & Rooney PC

(57) ABSTRACT

An image formation apparatus has a waste toner accommodation unit including a toner transporting rotation member covered with a fixed pipe. As the member rotates, waste toner in the pipe is transported downstream. The toner transporting rotation member has an upstream portion with a recessed portion having a small diameter. As the toner transporting rotation member rotates, a detection plate located external to the waste toner accommodation unit repetitively moves and thus repetitively passes across a photo sensor. When the waste toner has reached the level of the pipe the waste toner is compressed in the pipe downstream and thus increases in density. This increases a load torque of the toner transporting rotation member and hence ruptures the recessed portion, and thus stops rotation. The photo sensor detects that the detection plate no longer passes across it, and thus detects a state full of toner.

6 Claims, 5 Drawing Sheets

IMAGE FORMATION APPARATUS UTILIZING DENSITY OF WASTE TONER TO DETECT AMOUNT THEREOF

This application is based on Japanese Patent Application No. 2007-165471 filed with the Japan Patent Office on Jun. 22, 2007, the entire content of which is hereby incorporated by reference.

BACKGROUND OF THE INVENTION

1. Field of the Invention

The present invention relates generally to image formation apparatuses and particularly to image formation apparatuses having a function detecting the amount of waste toner in a waste toner accommodation unit.

2. Description of the Related Art

Laser printers, copiers, multi function peripherals (MFPs) having their functions combined together, and other similar image formation apparatuses that fix toner on a printing sheet for printing have a photoreceptor drum, and an intermediate transfer belt. On the surfaces of such members, toner, and a carrier (a 2-component developing agent), which will hereinafter generally be referred to as waste toner, remain. Such waste toner is removed with a cleaner blade and accommodated in a waste toner accommodation unit, which is referred to as a waste toner box, for recovery. When the waste toner accommodation unit becomes full of waste toner, the waste toner accommodation unit is emptied or exchanged for disposal. Accordingly, to implement an apparatus reduced in size, improved in serviceability, inexpensive, and the like, it is important to optimize the amount of waste toner in the waste toner accommodation unit. To do so, an image formation apparatus is provided with a function detecting the amount of waste toner. When the amount of waste toner in the waste toner accommodation unit reaches a maximum accommodatable amount, an indication or the like is displayed to exchange the waste toner accommodation unit.

Conventionally the amount of waste toner in a waste toner accommodation unit is detected generally by a function configured to utilize an optical sensor to detect the toner's liquid level. FIGS. 7A and 7B are diagrams schematically showing a waste toner accommodation unit for illustrating a specific example of a configuration utilizing an optical sensor to detect toner's liquid level to detect the amount of waste toner in the waste toner accommodation unit, as conventional. The figures show a waste toner accommodation unit 1, which is assumed to be placed in the longitudinal direction of a cylindrical photoreceptor drum (not shown), (i.e., in the direction of the cylinder), and FIG. 7A schematically shows waste toner accommodation unit 1 as seen in a direction parallel to the longitudinal direction of the photoreceptor drum and FIG. 7B schematically shows the same as seen from cross section VIIB-VIIB in the direction of an arrow VIIB indicated in FIG. 7A.

With reference to FIGS. 7A and 7B, waste toner accommodation unit 1 as seen in its longitudinal direction has one side (a left side in FIG. 7B) provided with toner drop ports 2A and 2B. A cleaner blade 3A recovers residual waste toner on a surface of the photoreceptor drum, and an intermediate transfer belt. The recovered waste toner is dropped through toner drop ports 2A and 2B to waste toner accommodation unit 1 for recovery.

With reference to FIG. 7B, waste toner accommodation unit 1 as seen its longitudinal direction has a side remote from toner drop port 2B (a right side in FIG. 7B) provided with a liquid level detection unit 6 utilizing an optical sensor 6C.

Optical sensor 6C emits light, which is in turn guided by an emission-associated light guide 6A and thus emitted in waste toner accommodation unit 1 parallel to the longitudinal direction of waste toner accommodation unit 1, and passes through a photoreception-associated light guide 6B and is thus received by optical sensor 6C. Liquid level detection unit 6 detects transmittance from the quantities of light emitted and received, respectively, by optical sensor 6C, and thus detects that the liquid level of the waste toner accommodated in waste toner accommodation unit 1 has passed across a position of light emission from emission-associated light guide 6A.

However, such a result of detection provided by such conventional method of detecting an amount of waste toner is affected by the state of the liquid level of the toner. For example, if the waste toner accommodation unit is inclined, the toner has a liquid level inclined relative to the waste toner accommodation unit. Furthermore, if waste toner is not accommodated in the waste toner accommodation unit uniformly, it has an uneven liquid level. This results in a varying liquid level detection and thus prevents detecting the correct amount of the waste toner. Conventionally, such disadvantage has been handled by a waste toner accommodation unit having a capacity provided with a margin for accommodating toner, an image formation apparatus provided with an arrangement that levels toner's liquid level, and the like. In the FIGS. 7A and 7B example, waste toner accommodation unit 1 internally has a toner transporting rotation members 4A and 4B having a surface with an agitation fin in the form of a screw and extending in the longitudinal direction to be rotated by a gear 5, which serves as a rotation mechanism, in a direction indicated in FIG. 7A by an arrow. As toner transporting rotation members 4A and 4B are rotated by gear 5, the agitation fin in the form of the screw that is provided on a surface thereof moves rightward or leftward the waste toner dropping through tone drop ports 2A and 2B, shown in FIG. 7B at a left side, and thus accommodated, and agitates the waste toner in waste toner accommodation unit 1.

The method utilizing an optical sensor to detect a liquid level is also disadvantageous in that a resultant detection is affected by an emission unit and a photoreception unit that are soiled. More specifically, the emission and photoreception units are located at a position facing waste toner. When the emission and photoreception units have their surfaces soiled with waste toner, they contribute to detection with reduced precision and prevent detecting a correct amount of waste toner. This disadvantage has conventionally been handled by providing an image formation apparatus with a configuration cleaning the emission and photoreception units. In the FIGS. 7A and 7B example, a portion of toner transporting rotation member 4A that immediately underlies emission-associated light guide 6A and photoreception-associated light guide 6B has a light guide cleaner 7 in the form of a plate connected thereto. Light guide cleaner 7 as seen in the longitudinal direction of toner transporting rotation member 4A has a length equal to the distance from emission-associated light guide 6A to photoreception-associated light guide 6B, and as seen in a direction orthogonal to the longitudinal direction of toner transporting rotation member 4A has a length equal to the distance from toner transporting rotation member 4A to emission-associated light guide 6A and photoreception-associated light guide 6B. As toner transporting rotation member 4A rotates, light guide cleaner 7 rotates with toner transporting rotation member 4A serving as an axis of rotation. In doing so, it passes between emission-associated light guide 6A and photoreception-associated light guide 6B, and thus contacts a surface of emission-associated light guide 6A and that of photoreception-associated light guide 6B to clean them.

A conventional image formation apparatus that has such a configuration as above has a first disadvantage, i.e., a miniaturized, simplified and inexpensive image formation apparatus cannot be achieved.

Furthermore, if a waste toner accommodation unit containing a maximum accommodatable amount of waste toner is accordingly exchanged, and recycling the waste toner accommodation unit is intended and accordingly for example the waste toner therein is disposed in an environment without a specified process performed by waste disposers or the like, the waste toner, which is an industrial waste, may have an undesirable effect on the environment. Furthermore, the waste toner accommodation unit having reached the maximum accommodatable amount and accordingly removed from the image formation apparatus for exchange may be mistaken for a new waste toner accommodation unit. In other words, the waste toner accommodation unit configured as conventional has a second disadvantage, i.e., it may not be exchanged appropriately when it contains the maximum accommodatable amount of waste toner and is accordingly exchanged.

SUMMARY OF THE INVENTION

The present invention has been made to overcome such disadvantages. One object of the present invention is to provide an image formation apparatus that can utilize the density of waste toner in a waste toner accommodation unit to detect that the waste toner accommodation unit contains at least a predetermined amount of waste toner, to allow the waste toner accommodation unit to be appropriately exchanged.

To achieve the above object, the present invention in one aspect provides an image formation apparatus including: a waste toner accommodation unit accommodating waste toner recovered; a rotation unit having first and second ends rotatably connected to two internal opposite surfaces, respectively, of the waste toner accommodation unit, the rotation unit transporting the waste toner from the first toward second ends as the rotation unit rotates; a segmentation unit segmenting an interior of the waste toner accommodation unit into a first region covering a portion of the rotation unit and containing the rotation unit, and a second region excluding the first region, the segmentation unit having a plurality of holes in a direction along the rotation unit to allow the waste toner to communicate between the first and second regions; a rotation stopping mechanism stopping the rotation unit from rotating when a load torque of the rotation unit attains a predetermined torque value; and a determination unit determining that the waste toner in the waste toner accommodation unit has reached a predetermined amount when the rotation unit stops rotating.

The present image formation apparatus can utilize the density of waste toner in a waste toner accommodation unit to detect that the waste toner accommodation unit contains at least a predetermined amount of waste toner. This can provide the above described detection without an undesirable effect of the toner's liquid level. This can eliminate the necessity of introducing a function for eliminating the undesirable effect of the toner's liquid level and thus contribute to a miniaturized, simplified and inexpensive image formation apparatus.

Furthermore in the present image formation apparatus once the waste toner in the waste toner accommodation unit has reached the predetermined amount a mechanism for detecting that waste toner has reached the predetermined amount no longer functions. As such, as the waste toner accommodation unit having reached that state cannot be recycled simply by disposing the waste toner contained therein, a prescribed process is required to perform an appropriate process. As a result, the waste toner will be processed appropriately and can thus be deposed in an environment without significantly negatively affecting the environment. Furthermore, if the waste toner accommodation unit that contains the predetermined amount of waste toner and is accordingly removed from the image formation apparatus is mistaken for a new waste toner accommodation unit, the present image formation apparatus can detect such mistake immediately when it starts operation. The waste toner accommodation units can thus be exchanged appropriately.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter reference will be made to the drawings to describe an embodiment of the present invention. In the following description, identical parts and components are identically denoted. Their names and functions are also identical.

Figure 1:
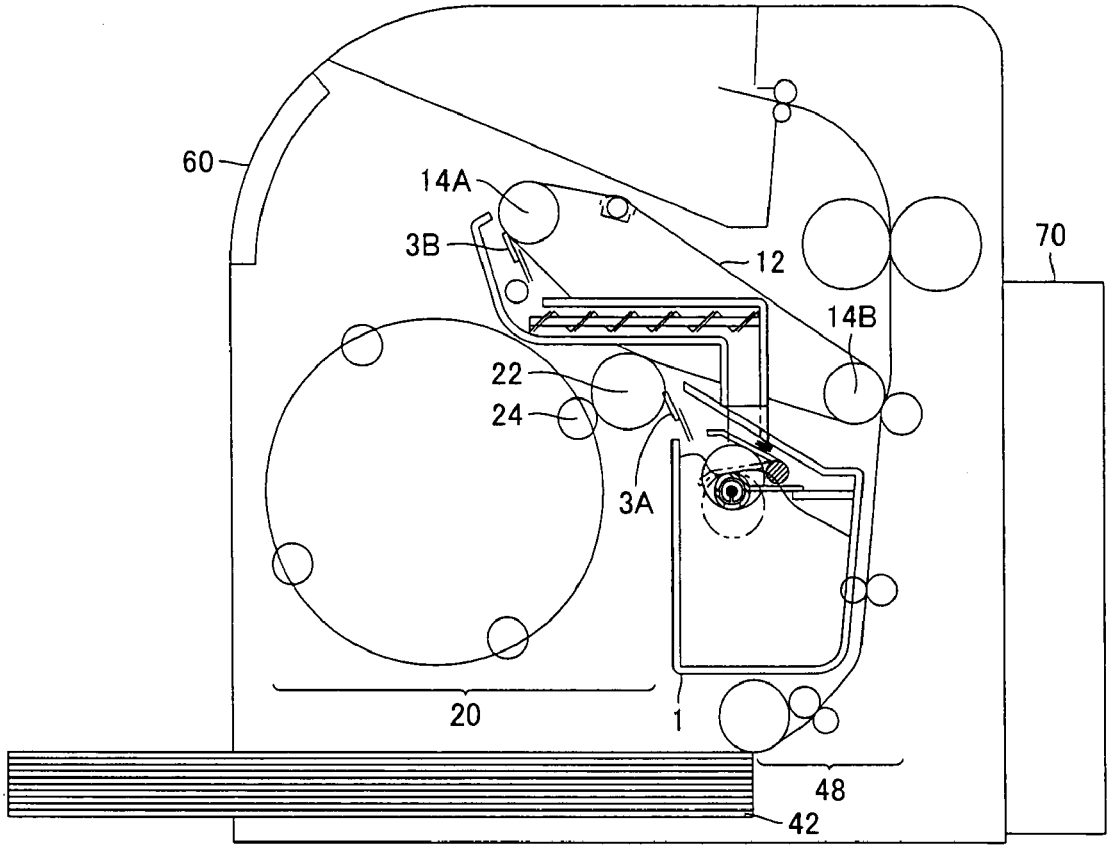
FIG. 1 schematically shows a specific example of an image formation apparatus 100 in configuration.

FIG. 1 schematically shows a specific example of an image formation apparatus 100 of the present embodiment in configuration as seen in a cross section taken along a plane. The present embodiment provides image formation apparatus 100 that fixes toner on a printing sheet for printing. More specifically, it corresponds to a laser printer, a copier, a multi function peripheral (MFP) having their functions combined together, or the like. With reference to FIG. 1, how image formation apparatus 100 is generally configured and operates to form an image will be described.

With reference to FIG. 1, image formation apparatus 100 includes an endless, intermediate transfer belt 12 suspended by a plurality of rollers 14A and 14B tight and rotating as rollers 14A and 14B rotate, an image formation unit 20 provided in contact with intermediate transfer belt 12, a sheet feeding cassette 42 accommodating a sheet S serving as a printing medium, a sheet transport unit 48 transporting sheet S delivered from sheet feeding cassette 42, a console panel 60 receiving an instruction from a user operating it, and a control unit 70 implemented for example by a central processing unit (CPU). Image formation unit 20 includes a photoreceptor drum 22, and a charger 24 charging a surface of photoreceptor drum 22 uniformly.

Furthermore there are also included a cleaner blade 3A recovering toner, and a carrier (a 2-component developing agent), which will hereinafter generally be referred to as waste toner, remaining on a surface of photoreceptor drum 22, a cleaner blade 3B recovering waste toner remaining on intermediate transfer belt 12, and a waste toner accommodation unit 1 accommodating the waste toner recovered by cleaner blades 3A and 3B.

Console panel 60 inputs to control unit 70 an operation signal based on an operation corresponding to an instruction of the user.

Control unit 70 operates in response to the operation signal received from console panel 60 to execute a predetermined program to subject an image signal, which is received for example from an external device, an image reading unit (not shown) or the like, to a predetermined image process to generate a digital signal, which is in turn input from control unit 70 to a print head (not shown). Furthermore, control unit 70 outputs, as required, control signals to the components shown in FIG. 1 for controlling motors for driving the sheet transport unit, a secondary transfer roller, and the like, respectively, to cause them to perform printing.

The digital signal output from control unit 70 to the print head corresponds to image color data used to form the aforementioned image through the aforementioned image process. The print head operates in accordance with the image color data received from control unit 70 to output a laser beam to photoreceptor drum 22.

Image formation unit 20 operates in response to the aforementioned control signal and the digital signal to provide exposure, development and transfer to register a toner image on intermediate transfer belt 12 (i.e., first transfer). More specifically, photoreceptor drum 22 has its surface uniformly charged, which is exposed by the print head in accordance with image data to have an electrostatic latent image formed thereon. The formed electrostatic latent image is developed with toner and a developer (not shown) forms a toner image on the surface of photoreceptor drum 22. Photoreceptor drum 22 is paired with a transfer charger (not shown) via intermediate transfer belt 12. The toner image formed on the surface of photoreceptor drum 22 is first transferred by the transfer charger onto intermediate transfer belt 12.

The toner image first transferred onto intermediate transfer belt 12 is secondarily transferred onto sheet S, which has a predetermined transfer potential applied thereto, as the sheet is transported from sheet feeding cassette 42 and brought into contact with intermediate transfer belt 12. Sheet S having the toner image transferred thereon is heated to fuse and thus fix the toner on sheet S.

Figure 2B:
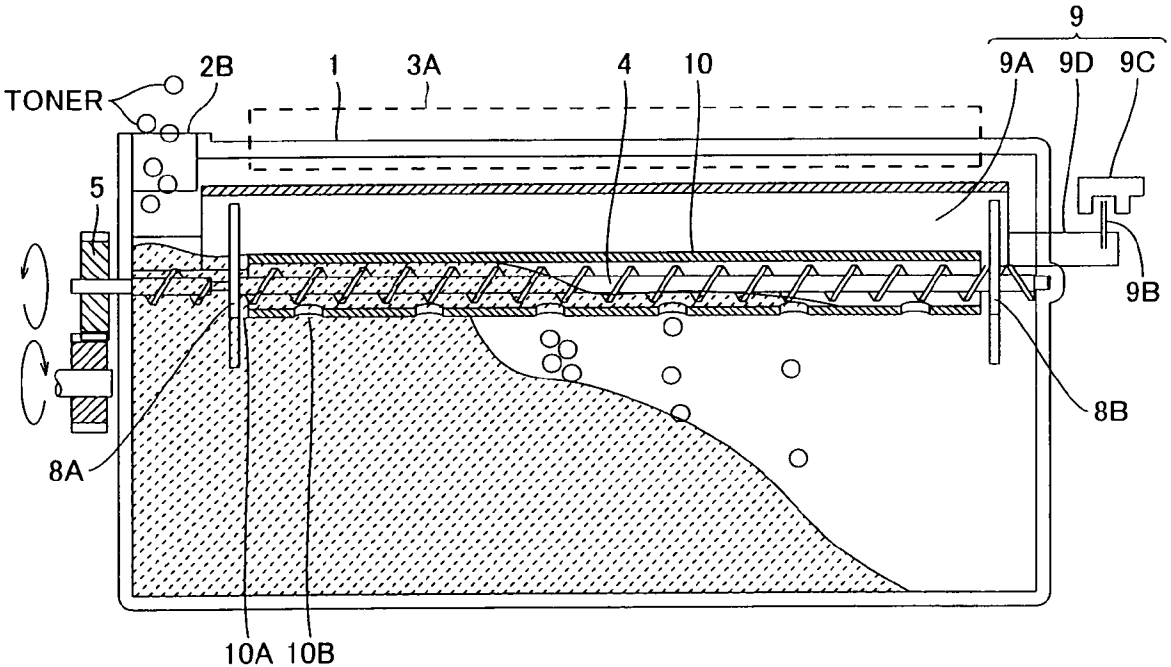
FIGS. 2A and 2B specifically show a waste toner accommodation unit 1 in configuration.
Figure 2A:
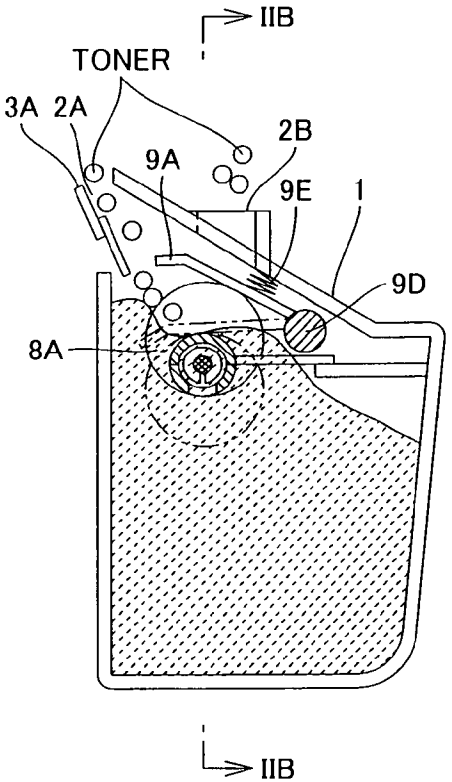

FIG. 2A schematically shows waste toner accommodation unit 1 as seen in a direction parallel to the longitudinal direction of photoreceptor drum 22 in the form of a cylinder, and FIG. 2B schematically shows the same as seen from cross section IIB-IIB in a direction indicated by an arrow IIB indicated in FIG. 2A.

With reference to FIG. 2B, waste toner accommodation unit 1 as seen in its longitudinal direction has one side (a left side in FIG. 2B) provided with a toner drop port 2B. Cleaner blade 3A recovers waste toner on a surface of photoreceptor drum 22. The recovered waste toner is dropped through toner drop port 2A to waste toner accommodation unit 1 and thus accommodated therein. Cleaner blade 3B recovers waste toner on intermediate transfer belt 12. The recovered waste toner is dropped through toner drop port 2B to waste toner accommodation unit 1 and thus accommodated therein. In the following description, as seen in the longitudinal direction of waste toner accommodation unit 1, the side provided with toner drop port 2B, (i.e., the left side in FIG. 2B) will be referred to as the "upstream" side, and the side opposite to that provided with toner drop port 2B, (i.e., the right side in FIG. 2B) will be referred to as the "downstream" side.

Furthermore, with reference to FIGS. 2A and 2B, waste toner accommodation unit 1 includes: a toner transporting rotation member 4 having a surface having an agitation fin in the form of a screw; cams 8A and 8B that are movable members connected to toner transporting rotation member 4 at upstream and downstream portions, respectively, with their respective relative positions fixed, and convert rotation into upward and downward movement to move upward and downward; a unit 9 detecting the amount of toner; a pipe 10 serving as a segmentation unit covering toner transporting rotation member 4; and a gear 5 serving as a mechanism rotating toner transporting rotation member 4.

Toner transporting rotation member 4 has opposite ends secured to those two internal surfaces of waste toner accommodation unit 1 which are opposite as seen in the longitudinal direction of waste toner accommodation unit 1. Toner transporting rotation member 4 is positioned to be slightly lower in level than the liquid level of the toner accommodated in waste toner accommodation unit 1 that has reached an amount for which waste toner accommodation unit 1 should be emptied or exchanged. i.e., it is positioned closer to the bottom of waste toner accommodation unit 1 than the liquid level is. Note that in the following description the state with waste toner having reached such amount will also be referred to as "the state full of toner".

As shown in FIG. 2B, pipe 10 is secured to the casing of waste toner accommodation unit 1. Toner transporting rotation member 4 rotates in pipe 10 as gear 5 rotates. Preferably, toner transporting rotation member 4 has a cylindrical geometry having a cross section in the form of a circle as seen in a direction traversing the longitudinal direction of waste toner accommodation unit 1, and rotates around the center of the circle. However, the cross section of toner transporting rotation member 4 as seen in the direction traversing the longitudinal direction of waste toner accommodation unit 1 is not limited to the circle; it may be a different cross section, such as an ellipse, a rectangle, a triangle, or the like.

Cams 8A and 8B connected at the upstream and downstream portions, respectively, of toner transporting rotation member 4 may not necessarily be connected to both the upstream and downstream portions, respectively, of toner transporting rotation member 4; they may be connected at least at the upstream portion. Preferably, however, they are connected to the upstream and downstream portions, respectively, of toner transporting rotation member 4, one at a portion, as shown, when their function as a mechanism moving upward and downward a toner compression fin 9A included in unit 9 detecting the amount of toner, as will be described later, is noted. As toner transporting rotation member 4 rotates, cams 8A and 8B move upward and downward with their respective phases varying such that the phases maintain their relative relationship. Preferably, cams 8A and 8B are identical in size and their positions relative to toner transporting rotation member 4 are also identical.

Pipe 10 is preferably also cylindrical having a cross section in the form of a circle as seen in a direction traversing the longitudinal direction of waste toner accommodation unit 1. However, pipe 10 is also not limited to such cross section; it may have a different cross section, such as an ellipse, a rectangle, a triangle, or the like. Pipe 10 is internally hollowed and has an inner diameter of such a dimension that at least when toner transporting rotation member 4 rotates, its agitation fin does not contact the internal side of pipe 10. In other words, toner transporting rotation member 4 rotates in pipe 10 without contacting the internal wall of pipe 10.

Pipe 10 has a length smaller than the distance between cams 8A and 8B connected to the upstream and downstream portions, respectively, of toner transporting rotation member 4 and has a plurality of holes 10A, 10B, . . . bored in its longitudinal direction as a toner inlet and outlet. While holes 10A, 10B are not limited to any particular number, position, interval or the like, it is assumed that at least two such holes are bored at upstream and downstream portions, respectively, of pipe 10. Holes 10A, 10B, . . . have a diameter, which is only required to be at least larger than that of a toner particle. As such, when the waste toner in waste toner accommodation unit 1 reaches the amount reaching pipe 10, the waste toner enters pipe 10 through holes 10A, 10B, . . .

FIGS. 2A and 2B shows a hatched portion, which indicates waste toner. As has been described above, toner drop ports 2A and 2B are provided at the upstream side. Accordingly, waste toner is accommodated more at the upstream side in particular. As such, the waste toner accommodated in waste toner accommodation unit 1 reaches the level of pipe 10 faster at the upstream side than at the downstream side and enters pipe 10 through a hole bored at the upstream portion of pipe 10. As toner transporting rotation member 4 rotates in pipe 10, the agitation fin in the form of the screw that is provided at a surface of toner transporting rotation member 4 moves toward the downstream side the waste toner having entered pipe 10. In doing so, the waste toner is transported onto any of holes 10A, 10B, . . . provided between the upstream and downstream sides and thus drops through the hole out of pipe 10. FIG. 2A shows waste toner thus dropping. In other words, gear 5, toner transporting rotation member 4, and pipe 10 function as a mechanism leveling the liquid level of toner in waste toner accommodation unit 1 uniformly. This can increase the amount of waste toner that waste toner accommodation unit 1 can accommodate.

Note that while this example provides a mechanism leveling waste toner by transporting waste toner in pipe 10 from the upstream to downstream sides as toner transporting rotation member 4 having a surface with an agitation fin in the form of a screw rotates, waste toner in pipe 10 may be transported from the upstream to downstream sides by a configuration other than the agitation fin in the form of the screw; any other configuration may be used that can convert the rotation of toner transporting rotation member 4 to a force moving waste toner in pipe 10 from the upstream to downstream sides and transport the waste toner as toner transporting rotation member 4 rotates.

When waste toner accommodated in waste toner accommodation unit 1 from the upstream side down to the downstream side attains an amount reaching the level of pipe 10 and the state full of toner is thus attained, the waste toner in pipe 10 transported onto any of holes 10A, 10B, . . . does not drop therethrough and thus remains in pipe 10. Consequently, pipe 10 is full of waste toner from the upstream side down to the downstream side. If toner transporting rotation member 4 continues to rotate in that condition, the agitation fin presses the internal waste toner toward the downstream side and as a result the waste toner in pipe 10 increases in density. This increases a load torque of that portion of toner transporting rotation member 4 which is accommodated in pipe 10. It can thus be said that gear 5, toner transporting rotation member 4 and pipe 10 provide a first mechanism for increasing a load torque of toner transporting rotation member 4.

Furthermore, at the agitation fin of that portion of toner transporting rotation member 4 which is accommodated in pipe 10, i.e., at toner transporting rotation member 4 accommodated in pipe 10, a stress toward the upstream side is generated. It can thus be said that pipe 10 is a member covering toner transporting rotation member 4 as well as a segmentation member segmenting a waste toner accommodation area internal to waste toner accommodation unit 1 into a region including toner transporting rotation member 4 and the remaining region.

Figure 3:
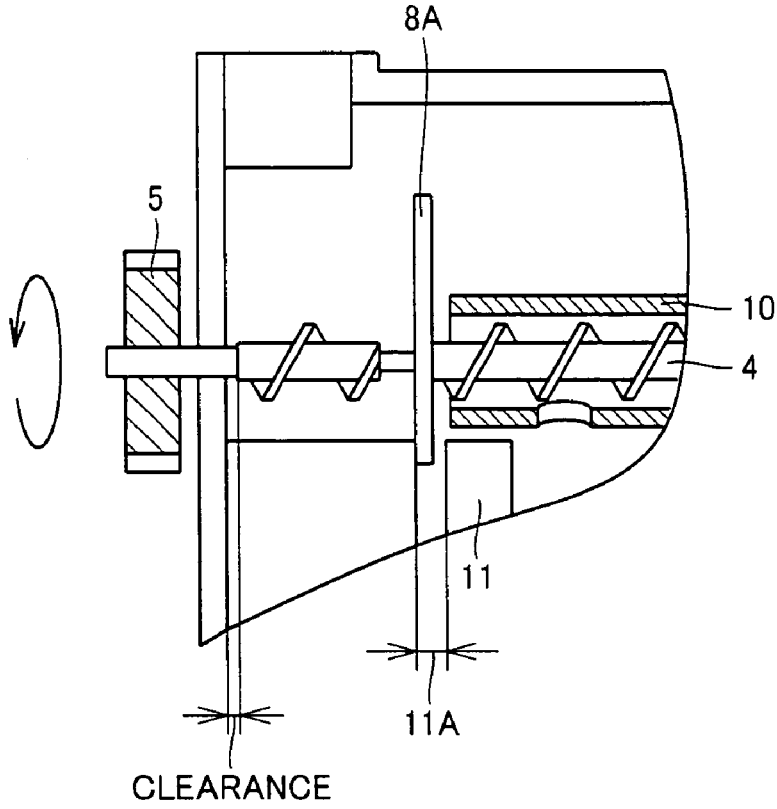
FIG. 3 specifically shows the most upstream portion of a toner transporting rotation member 4 in configuration.

FIG. 3 shows a specific example of the most upstream portion of toner transporting rotation member 4 in configuration. As shown in FIG. 3, toner transporting rotation member 4 has the most upstream portion provided with a clearance (also referred to as an allowance, which is so called backlash, play or the like) to absorb that movement of toner transporting rotation member 4 caused toward the upstream side as a stress is generated at toner transporting rotation member 4 toward the upstream side. The clearance is normally designed to be provided to a screw, which rotates such that a shaft via a bored hole serves as an axis of rotation, to absorb the movement of the shaft caused by the stress caused at the screw's fin as the screw rotates, and the shaft has a diameter, which is larger than that of the hole, reduced for a predetermined length, as measured from a wall, to be equal to or smaller than the diameter of the hole in a direction opposite to that in which the shaft moves. In other words, the shaft has a diameter reduced for the predetermined length, as seen from the wall, to be out of the wall by an amount corresponding to the movement of the shaft. In the following description, that portion of toner transporting rotation member 4 which is reduced in diameter as a clearance will be referred to as a first diameter reduced portion.

Furthermore, with reference to FIG. 3, toner transporting rotation member 4 has a diameter reduced for a predetermined length, as seen toward the upstream side from cam 8A connected to the upstream portion of toner transporting rotation member 4. In the following description, this portion reduced in diameter will be referred to as a second diameter reduced portion. The second diameter reduced portion is not limited to a particular diameter; it may have any diameter as long as it is the smallest diameter of toner transporting rotation member 4 as seen in its longitudinal direction. In other words, the second diameter reduced portion can be said to be the thinnest portion of toner transporting rotation member 4 and a recessed portion of toner transporting rotation member 4. The longitudinal length (i.e., the aforementioned predetermined length) of the second diameter reduced portion is not limited to a particular length.

Furthermore, with reference to FIG. 3, there is provided a platform 11 extending in waste toner accommodation unit 1 from the upstream side toward the downstream side to at least reach cam 8A and having a position fixed relative to waste toner accommodation unit 1. Platform 11 has a gap 11A as a recess. The distance between platform 11 and the center of the rotation of toner transporting rotation member 4 is not limited to any particular distance, although it is smaller than the smallest length of cam 8A as seen from the center of the rotation of toner transporting rotation member 4.

Gap 11A is positioned under cam 8A. The distance from the most upstream internal wall of waste toner accommodation unit 1 to the most downstream portion of gap 11A is not limited to any particular distance. However, at least, it is larger than the distance from the most upstream internal wall of waste toner accommodation unit 1 to that position of the upstream surface of cam 8A which is assumed when cam 8A is located most downstream. If gap 11A has a width a, gap 11A is provided in platform 11 with width a provided from the most downstream position of gap 11A toward the upstream side. Herein, if toner transporting rotation member 4 has the first diameter reduced portion having a longitudinal length b, a<b is established.

Furthermore the distance between the bottom of gap 11A and the center of the rotation of toner transporting rotation member 4, i.e., the depth of gap 11A as measured from the center of the rotation of toner transporting rotation member 4 is not limited to any particular distance. However, at least, it is larger than the largest length of cam 8A as measured from the center of the rotation of toner transporting rotation member 4.

As such, when cam 8A moves upward and downward as toner transporting rotation member 4 rotates, cam 8A has at least a portion moving upward and downward in gap 11A of platform 11. Furthermore, when the stress caused at the agitation fin of toner transporting rotation member 4 toward the upstream side moves toner transporting rotation member 4 to the upstream side, cam 8A has its upstream surface interfering with an upstream end of gap 11A before toner transporting rotation member 4 moves toward the upstream side by width b of the first diameter reduced portion serving as the clearance. In that condition, as toner transporting rotation member 4 further rotates, cam 8A moves upward and downward with its upstream surface interfering with the upstream end of gap 11A, and between the upstream surface of gap 11A and that of cam 8A there is generated upward and downward stress attributed to friction. Accordingly, preferably, gap 11A and cam 8A have their respective upstream surfaces surface-processed to have a surface roughness serving as a coefficient of friction of some extent (other than zero).

In the FIG. 3 example, as toner transporting rotation member 4 rotates, cam 8A interferes with the upstream end of gap 11A. Alternatively, cam 8B may do so. However, as the cam is a mechanism interfering with the upstream end of gap 11A as toner transporting rotation member 4 is moved toward the upstream side by the stress generated at the agitation fin toward the upstream side as the toner in pipe 10 increases in density, the upstream cam 8A is preferable to the downstream cam 8B, since cam 8A is more susceptible to the movement of toner transporting rotation member 4. Furthermore, other than cams 8A and 8B, a projecting member that can interfere with the upstream end of toner transporting rotation member 4 may be provided to toner transporting rotation member 4, the projecting member moving repetitively (upward and downward) along the upstream end of gap 11A as toner transporting rotation member 4 rotates. For a similar ground, the projecting member is provided to toner transporting rotation member 4 preferably at a portion uncovered with pipe 10 and close to the upstream side. The FIG. 3 example shows a configuration having cam 8A also serving as the projecting member.

The upward and downward stress attributed to friction that is caused between the upstream surface of gap 11A and that of cam 8A increases the load torque of the entirety of toner transporting rotation member 4 having cam 8A connected thereto. It can thus be said that gear 5, toner transporting rotation member 4, cam 8A and gap 11A are a second mechanism for increasing the load torque of toner transporting rotation member 4.

When the state full of toner is attained, the load torque of that portion of toner transporting rotation member 4 which is covered with pipe 10 is increased by both of two factors, i.e., the waste toner in pipe 10 increasing in density (i.e., the first mechanism) and the friction between the upstream surface of gap 11A and that of cam 8A (i.e., the second mechanism). The load torque of that portion of toner transporting rotation member 4 which is upstream of that portion thereof covered with pipe 10, i.e., the load torque of the upstream portion of toner transporting rotation member 4 uncovered with pipe 10 is less susceptible to the waste toner in pipe 10 increasing in density than the load torque of that portion of toner transporting rotation member 4 which is covered with pipe 10. In other words, when the state full of toner is attained, the load torque of the upstream portion of toner transporting rotation member 4 uncovered with pipe 10 is increased by propagation of the increase of the load torque of that portion of toner transporting rotation member 4 which is covered with pipe 10 and by the friction between the upstream surface of gap 11A and that of cam 8A.

Thus in the state full of toner there is a difference between that portion of toner transporting rotation member 4 which is covered with pipe 10 and the upstream portion of toner transporting rotation member 4 uncovered with pipe 10 with respect to how their load torques increase. Thus, in the state full of toner, toner transporting rotation member 4 has torsion. Of toner transporting rotation member 4, the second diameter reduced portion is smallest in diameter. Accordingly, a shearing stress generated by torsion, i.e., a torsion stress concentrates at the second diameter reduced portion. When the torsion stress of the second diameter reduced portion reaches the rupture strength of toner transporting rotation member 4, the second diameter reduced portion ruptures.

Note that the above configuration serving as the second mechanism for increasing a load torque exhibits the function increasing the load torque as the first mechanism for increasing the load torque of toner transporting rotation member 4 increases the load torque of that portion of toner transporting rotation member 4 located in pipe 10 and a stress is generated at toner transporting rotation member 4 internal to pipe 10 toward the upstream side to press the upstream surface of cam 8A against the upstream surface of gap 11A located upstream, as described above. In other words, it can be said that the first mechanism serves as a main mechanism increasing the load torque of that portion of toner transporting rotation member 4 internal to pipe 10 and the second mechanism serves as an assistive mechanism. Accordingly, image formation apparatus 100 may include only the first mechanism and the second diameter reduced portion may rupture when the load torque of toner transporting rotation member 4 reaches a predetermined torque value by the first mechanism alone.

Figure 4:
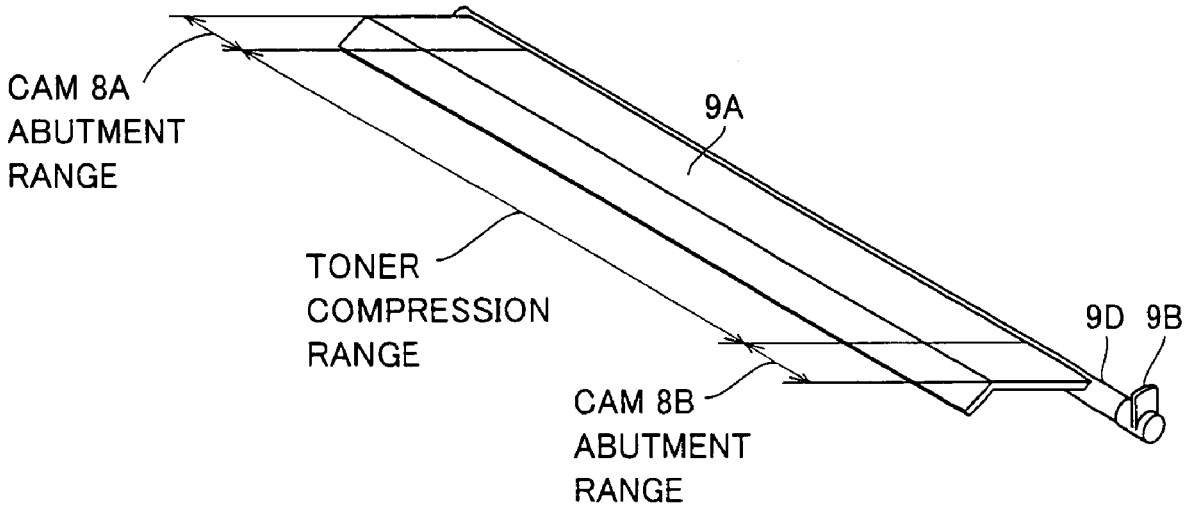
FIG. 4 specifically shows a portion of a unit 9 detecting the amount of toner.

FIG. 4 specifically shows one example of a portion of unit 9 detecting the amount of toner. With reference to FIGS. 2A, 2B and 4, unit 9 detecting the amount of toner includes: a toner compression fin 9A also including a toner compression mechanism (a paddle) provided parallel (or generally parallel) to the longitudinal direction of toner transporting rotation member 4 to serve as a member detecting the amount of toner; a shaft 9D of the member detecting the amount of toner, that secures to waste toner accommodation unit 1 one end of toner compression fin 9A that is parallel to the longitudinal direction of toner transporting rotation member 4; a plate 9B connected to a downstream portion of shaft 9D, with its relative position fixed, for detecting the amount of toner; and a photo sensor 9C having a position fixed relative to waste toner accommodation unit 1.

When toner compression fin 9A is noted as a function serving as a mechanism detecting the amount of toner, as will be described later, the length of toner compression fin 9A in the longitudinal direction of toner transporting rotation member 4 is only required to be that which can abut against at least one of cams 8A and 8B and thus enjoy the effect(s) of its/their upward and downward movement(s). To enjoy both of the effects of their upward and downward movements steadily, however, it is preferable that toner compression fin 9A have a length at least larger than the distance between cams 8A and 8B and be positioned parallel to the longitudinal direction of toner transporting rotation member 4 to cover cams 8A and 8B. Furthermore, toner compression fin 9A is also noted as a function serving as a toner compression mechanism as described later, and in that case, it is preferable that the length of toner compression fin 9A in the longitudinal direction of toner transporting rotation member 4 be as large a length as possible that does not exceed that of waste toner accommodation unit 1 which is between its upstream and downstream internal walls.

Figure 5:
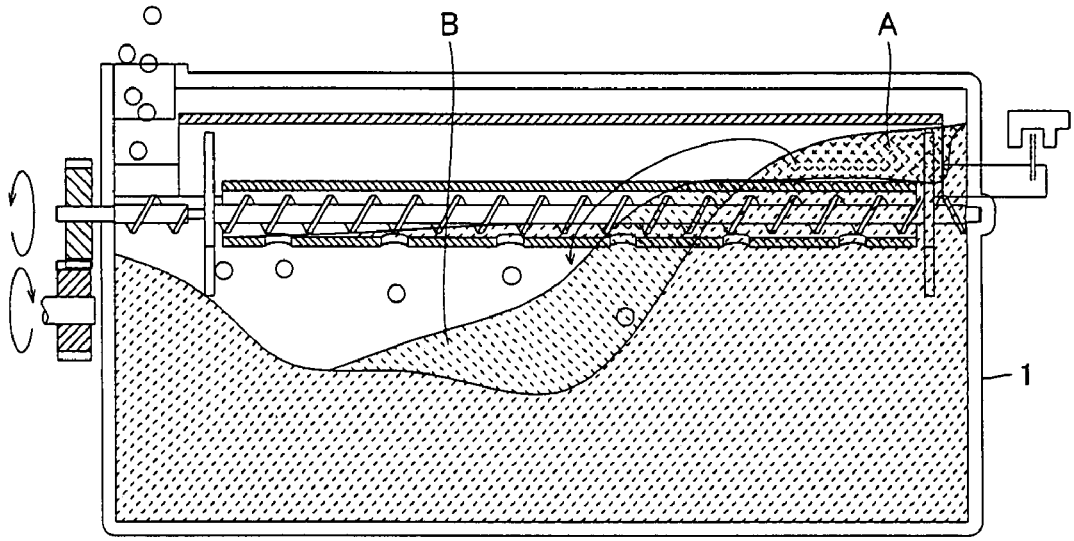
FIG. 5 is a diagram for illustrating a mechanism compressing waste toner in waste toner accommodation unit 1.

Shaft 9D of the member detecting the amount of toner has at least one end pivotably connected to waste toner accommodation unit 1 parallel to the longitudinal direction of toner transporting rotation member 4, and one end of toner compression fin 9A that is parallel (or generally parallel) to the longitudinal direction of toner transporting rotation member 4 is connected to shaft 9D such that the former does not have a position varying relative to the latter. Shaft 9D is pivotably connected to waste toner accommodation unit 1 and preferably the distance from the bottom of waste toner accommodation unit 1 to shaft 9D (i.e., the level of shaft 9D as seen from the bottom of waste toner accommodation unit 1) is generally equal to or greater than the position (or level) of pipe 10. As shown in FIG. 2A, toner compression fin 9A is connected to an upper internal wall internal to waste toner accommodation unit 1 by a spring or a similar elastic member 9E exerting elastic force pressing toner compression fin 9A from the upper internal wall internal to waste toner accommodation unit 1 toward pipe 10. As such, when the liquid level of the waste toner in waste toner accommodation unit 1 reaches to a vicinity of toner compression fin 9A, the waste toner is compressed by toner compression fin 9A pressed by the elastic force of elastic member 9E. In other words, gear 5, toner transporting rotation member 4, cams 8A and 8B, toner compression fin 9A, shaft 9D of the member detecting the amount of toner, and elastic member 9E function as a mechanism for compressing waste toner in waste toner accommodation unit 1. Thus, as shown for example in FIG. 5, if waste toner accommodation unit 1 is inclined and its internal waste toner does not deposit uniformly (see FIG. 5, a hatched portion A), toner compression fin 9A moving upward and downward returns the waste toner to have a flat liquid level (see FIG. 5, an arrow and a hatched portion B). This can increase the amount of waste toner that waste toner accommodation unit 1 can accommodate. The returned waste toner will again clog holes 10A, 10B, . . . of pipe 10.

Furthermore, toner compression fin 9A that is pressed by the elastic force of elastic member 9E in a direction from the upper internal wall internal to waste toner accommodation unit 1 toward pipe 10 abuts against cams 8A and 8B, and in that condition, as cams 8A and 8B move upward and downward, toner compression fin 9A accordingly pivots around shaft 9D. As toner compression fin 9A pivots, shaft 9D rotates around its center at a predetermined central angle, and its rotation is propagated to plate 9B connected thereto. As a result, plate 9B pivots around shaft 9D as toner compression fin 9A pivots.

Plate 9B is connected to shaft 9D in a direction at least forming an angle with a straight line parallel to shaft 9D, and preferably, as shown in FIG. 4, plate 9B is connected to shaft 9D at a right angle relative to the straight line parallel to shaft 9D. The length of plate 9B in the circumferential direction of shaft 9D is not limited to any particular length, although it is smaller than the entire circumference of the shaft and at least partially lacks in the circumferential direction.

Photo sensor 9C is only required to have a mechanism calculating the transmittance, reflectance and the like of the light emitted from the emission side to detect whether an object obstructing the emission is present/absent. In this example, it includes a light emitting element and a photoreceptive element and calculates transmittance to detect whether plate 9B is present/absent between the elements. The light emitting element of photo sensor 9C emits light in the longitudinal direction of toner transporting rotation member 4 and the photoreceptive element thereof receives the light.

The position of photo sensor 9C in a direction parallel to shaft 9D is that allowing plate 9B to exist between the light emitting element and the photoreceptive element. The position of photo sensor 9C in the circumferential direction of shaft 9D and the width (of a slit) of the emission range or detection area thereof in the circumferential direction are such a position and a width that allow the detection area to partially overlap a range for which plate 9B pivots as toner compression fin 9A pivots. More specifically, the position and the width are such a position and a width that as toner compression fin 9A pivots, plate 9B passes through the detection area, and when toner compression fin 9A reaches a topmost position or a bottommost position, plate 9B has at least a portion outer than the detection area. The distance (or gap) between the light emitting element and photoreceptive element of photo sensor 9C is preferably that at least larger than the thickness of plate 9B and allowing plate 9B to pass between the light emitting element and the photoreceptive element.

Thus, as toner transporting rotation member 4 rotates, cams 8A and 8B move upward and downward, and toner compression fin 9A pressed against cams 8A and 8B by the elastic force of elastic member 9E pivots around shaft 9D. The pivoting of toner compression fin 9A is propagated as the rotation of shaft 9D to plate 9B, and plate 9B pivots while obstructing the detection area of photo sensor 9C as toner compression fin 9A pivots. By the positional relationship between plate 9B and the detection area of photo sensor 9C, the area of plate 9B obstructing the detection area of photo sensor 9C varies as plate 9B pivots. The amount of such variation is detected by the variation in transmittance of the light emitted at photo sensor 9C.

As described above, once the second diameter reduced portion of toner transporting rotation member 4 has ruptured, toner transporting rotation member 4 downstream of the ruptured portion stops rotating, and accordingly, cams 8A and 8B also stop moving upward and downward. As a result, toner compression fin 9A also stops pivoting, and so does plate 9B. When plate 9B stops pivoting, the area of plate 9B obstructing the detection area of photo sensor 9C will no longer vary.

Figure 6:
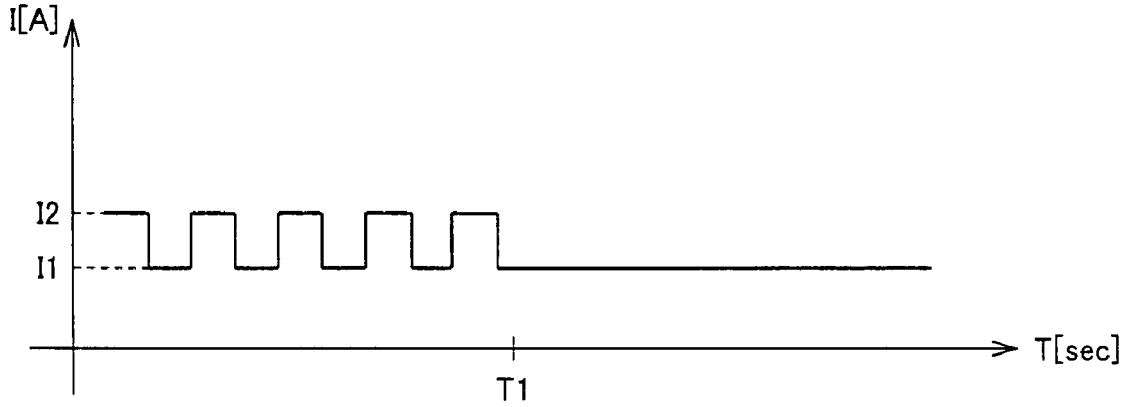
FIG. 6 shows a specific example of how a detection signal of a photo sensor 9C varies with time.
Figure 7B:
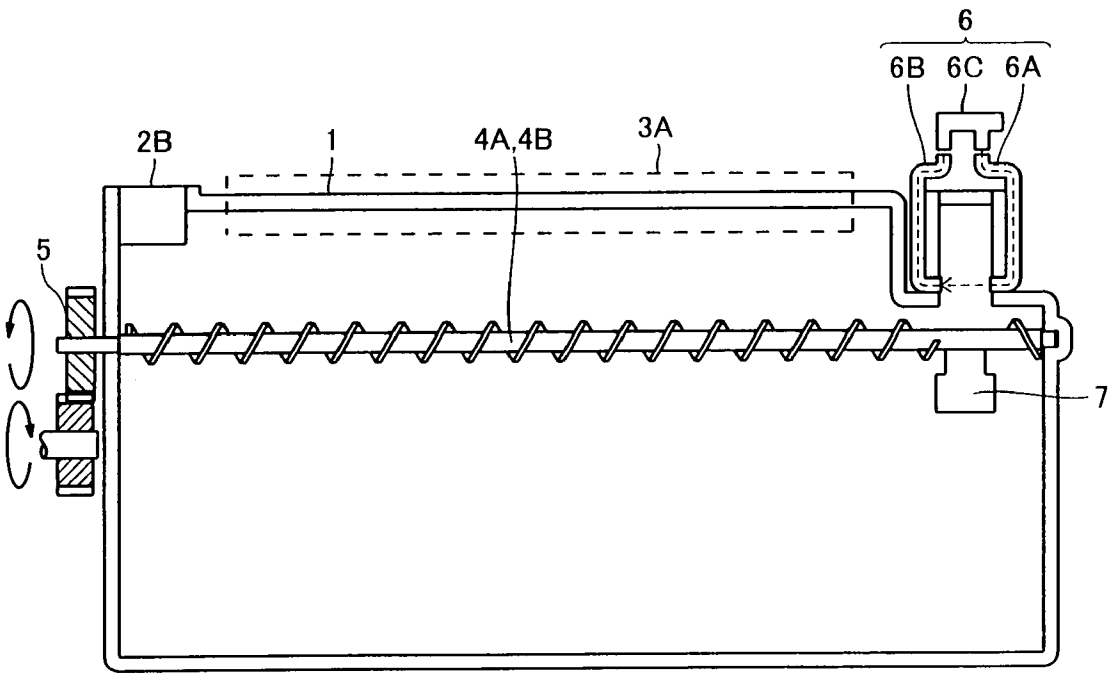
FIGS. 7A and 7B schematically show a waste toner accommodation unit mounted in a conventional image formation apparatus.
Figure 7A:
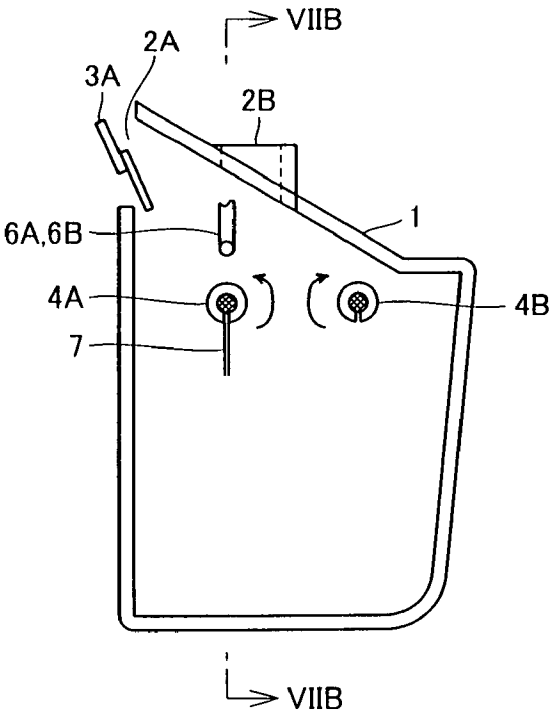

FIG. 6 shows a specific example of how a detection signal of a photo sensor 9C varies with time. The horizontal axis represents time T elapsing in seconds, and the vertical axis represents an output value of the detection signal by an output current I in ampere. The output value of the detection signal may alternatively be represented by a value in voltage, resistance, or the like.

With reference to FIG. 6, time T1 indicates a time at which toner transporting rotation member 4 has the second diameter reduced portion ruptured. Before time T1 arrives, the transmittance periodically varies as the area of plate 9B obstructing the detection area of photo sensor 9C periodically varies. Accordingly, the detection signal output has a value periodically varying between a minimum value I1 and a maximum value I2. When time T1 arrives, the area of plate 9B obstructing the detection area of photo sensor 9C will no longer vary and the transmittance will accordingly no longer vary. Accordingly the detection signal output has a fixed value. In the FIG. 6 example, when time T1 arrives, minimum value I1 is output as the fixed value. However, the fixed value is determined by a positional relationship assumed at time T1 between plate 9B and the detection area of photo sensor 9C and can assume a range from a value output when plate 9B does not obstruct the detection area of photo sensor 9C at all to a value output when plate 9B completely obstructs the detection area of photo sensor 9C.

The detection signal output from photo sensor 9C is input to control unit 70. Control unit 70 has a value It between minimum value I1 and maximum value I2 previously stored therein as a threshold value and compares the variation of the output value obtained from the detection signal output from photo sensor 9C with threshold value It successively. As a result of such comparison when control unit 70 detects that the output value does not match threshold value It for a predetermined period of time, control unit 70 determines that the output value does not have variation. In FIG. 6, control unit 70 detects after time T1 that the output value does not have variation. In other words, gear 5, toner transporting rotation member 4, pipe 10, cams 8A and 8B, unit 9 detecting the amount of toner, and control unit 70 function as a mechanism for detecting the amount of waste toner in waste toner accommodation unit 1. Thus, that the amount of waste toner in waste toner accommodation unit 1 has reached the state full of toner, is detected.

Control unit 70 having detected that the output value no longer varies accordingly detects that toner transporting rotation member 4 has the second diameter reduced portion ruptured, and control unit 70 causes console panel 60 to accordingly display an indication, i.e., a screen indicating that the state full of toner has been reached.

Image formation apparatus 100 of the present embodiment that is configured as described above allows the density of toner to be utilized to detect that the amount of toner in waste toner accommodation unit 1 has reached the state full of toner. This allows the state full of toner to be detected with high precision without considering the state of the liquid level of the toner. This can urge exchanging waste toner accommodation unit 1 timely and eliminate the necessity of providing waste toner accommodation unit 1 with a margin for accommodating toner.

Furthermore, when image formation apparatus 100 of the present embodiment has reached the state full of toner, its toner density increases, and when it reaches an amount, the torsion stress of toner transporting rotation member 4 reaches rupture strength and the second diameter reduced portion ruptures to allow the state full of toner to be detected. This can eliminate the necessity of introducing a load torque limiter or a like configuration measuring a load torque, and allows a simple configuration to be employed to detect that a predetermined load torque or larger is reached, i.e., that the state full of toner is reached. Furthermore, a sensor is provided at a location that is outer than waste toner accommodation unit 1 and is thus not exposed to waste toner. This can eliminate the necessity of introducing a configuration cleaning the sensor. Furthermore, a photo sensor less expensive than a photo sensor can be used to detect that the amount of waste toner in waste toner accommodation unit 1 has reached the state full of toner.

Image formation apparatus 100 of the present embodiment can thus be miniaturized, simplified and inexpensive.

Furthermore in the present embodiment when the state full of toner is reached the toner increases in density and when it reaches an amount the torsion stress of toner transporting rotation member 4 reaches rupture strength and the second diameter reduced portion ruptures. Waste toner accommodation unit 1 in that condition cannot be recycled simply by disposing the waste toner accommodated therein, and to thereafter operate image formation apparatus 100, a predetermined operation must be done, such as having a particular waste disposer to handle the waste toner. As a result, the waste toner, i.e., industrial waste, can be handled appropriately to ensure that the waste toner is for example not disposed in an environment inappropriately and thus does not negatively affect the environment.

Furthermore if waste toner accommodation unit 1 that has reached a maximum accommodatable amount and accordingly been removed from image formation apparatus 100 for exchange is mistaken for a new waste toner accommodation unit, and image formation apparatus 100 is operated in that condition, the mechanism for detecting the amount of waste toner does not function, and such mistake is immediately detected. As a result the waste toner accommodation units can be exchanged appropriately.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation apparatus comprising:

a waste toner accommodation unit accommodating waste toner recovered;

a rotation unit having first and second ends rotatably connected to two internal opposite surfaces, respectively, of said waste toner accommodation unit, said rotation unit transporting said waste toner from said first toward second ends as said rotation unit rotates;

a segmentation unit segmenting an interior of said waste toner accommodation unit into a first region covering a portion of said rotation unit and containing said rotation unit, and a second region excluding said first region, said segmentation unit having a plurality of holes in a direction along said rotation unit to allow said waste toner to communicate between said first and second regions;

a rotation stopping mechanism stopping said rotation unit from rotating when a load torque of said rotation unit attains a predetermined torque value; and a determination unit determining that said waste toner in said waste toner accommodation unit has reached a predetermined amount in response to said rotation unit stopping rotating.

2. The image formation apparatus according to claim 1, wherein said rotation unit at a portion adjacent to said first end and uncovered with said segmentation unit has a recessed portion as said rotation stopping mechanism, said recessed portion rupturing when said load torque of said rotation unit reaches said predetermined torque value.

3. The image formation apparatus according to claim 1, wherein:

said determination unit includes a plate involved in detecting an amount of toner, said plate repetitively moving by a predetermined amount as said rotation unit rotates, and a sensor detecting that said plate repetitively moves; and said determination unit determines from an output received from said sensor that said plate stops repetitively moving.

4. The image formation apparatus according to claim 1, said rotation unit having a projecting portion repetitively moving as said rotation unit rotates, further comprising a member having a recess with a position fixed relative to said waste toner accommodation unit, said recess having an internal surface interfering with a surface of said projecting portion that is closer to said first end, wherein said load torque of said rotation unit is increased by a frictional force caused as said projecting portion repetitively moves while said surface of said projecting portion that is closer to said first end interferes with said internal surface of said recess.

5. The image formation apparatus according to claim 1, further comprising a toner compression fin moving upward and downward with a predetermined amplitude as said rotation unit rotates, to compress said waste toner accommodated in said waste toner accommodation unit.

6. The image formation apparatus according to claim 1, further comprising an indication unit indicating that said waste toner in said waste toner accommodation unit has reached said predetermined amount.

* * * * *